United States Patent [19]

Meier

[11] Patent Number: 4,532,750

[45] Date of Patent: Aug. 6, 1985

[54] WINDING BODY FOR WINDING-UP CONTINUOUSLY ARRIVING FLAT STRUCTURES, ESPECIALLY PRINTED PRODUCTS IN AN IMBRICATED PRODUCT FORMATION

[75] Inventor: Jacques Meier, Bäretswil, Switzerland

[73] Assignee: Ferag AG, Hinwil, Switzerland

[21] Appl. No.: 412,843

[22] Filed: Aug. 30, 1982

[30] Foreign Application Priority Data

Sep. 18, 1981 [CH] Switzerland ..... 6047/81

[51] Int. Cl.[3] ..... B65B 63/04

[52] U.S. Cl. ..... 53/118; 242/59; 242/65; 242/74

[58] Field of Search ..... 53/118, 119, 117, 116, 53/430; 242/59, 65, 74

[56] References Cited

U.S. PATENT DOCUMENTS

| | | | |
|---|---|---|---|
| 3,840,196 | 10/1970 | Presentey | 242/74 |
| 3,964,232 | 6/1971 | Bender et al. | 53/430 |
| 4,015,793 | 4/1977 | Hemminger | 242/74 |
| 4,026,485 | 5/1977 | Ambrose | 242/74 X |
| 4,291,460 | 9/1981 | Stoehr | 53/118 X |
| 4,438,618 | 3/1984 | Honegger | 53/118 X |
| 4,451,011 | 5/1984 | Engelsmann et al. | 242/74 X |

FOREIGN PATENT DOCUMENTS

| | | | |
|---|---|---|---|
| 2092557 | 8/1982 | United Kingdom | 242/59 |

*Primary Examiner*—James F. Coan

*Attorney, Agent, or Firm*—Werner W. Kleeman

[57] ABSTRACT

Internally of a winding core or body there is arranged a supply spool for a winding band and which supply spool is rotatably mounted upon a shaft of the winding core. The supply spool can be driven by means of a drive unit possessing a drive roll attached to a pivotable arm. Externally of the winding core or body there is arranged a spool member which serves as a intermediate storage for the winding band. Prior to winding-up the continuously arriving products upon the jacket or outer surface of the winding core or body there is wound-up upon the spool member the length of the winding band needed for forming the product package. For this purpose the supply spool is driven by the drive unit. Consequently, the winding band is forwardly advanced by a guide means provided at a rocker member and thereafter guided by a further rocker member towards the spool member. For winding-up the winding band upon the spool member the latter is driven by a drive motor. In each case there is only wound-up upon the spool member that length of the winding band which is needed for forming the product package upon the winding core or body. For winding-up the product formation upon the winding core or body, which product formation is infed by a band conveyor, the winding core or body is driven and the supply spool is braked.

18 Claims, 13 Drawing Figures

WINDING BODY FOR WINDING-UP CONTINUOUSLY ARRIVING FLAT STRUCTURES, ESPECIALLY PRINTED PRODUCTS IN AN IMBRICATED PRODUCT FORMATION

CROSS-REFERENCE TO RELATED APPLICATIONS

This application is related to the commonly assigned copending U.S. application Ser. No. 06/280,998, now U.S. Pat. No. 4,438,618 granted Mar. 27, 1984, filed July 6, 1981, entitled "APPARATUS FOR STACKING PRINTED PRODUCTS, SUCH AS NEWSPAPERS, PERIODICALS AND THE LIKE, ARRIVING IN AN IMBRICATED PRODUCT STREAM", and the commonly assigned copending U.S. application Ser. No. 06/338,568, filed Jan. 11, 1982, entitled: "METHOD AND APPARATUS FOR THE LONG-TERM PRESSING OF PRINTED PRODUCTS, ESPECIALLY NEWSPAPERS".

BACKGROUND OF THE INVENTION

The present invention relates to a new and improved winding body for winding-up flat structures, preferably printed products, which continuously arrive, especially in an imbricated product formation or array. The invention further pertains to a new and improved construction of winding apparatus containing a winding body which is of the type which interposes a layer of at least one winding band between the wound layers or plies of the products and contains a substantially cylindrical jacket or outer surface.

In German Patent Publication No. 2,207,556 there is disclosed to the art an apparatus for winding-up printed products arriving in an imbricated product formation. The arriving printed products move between two winding bands and in conjunction therewith are wound-up upon a winding drum. The winding bands are affixed at one end at the winding drum and, during winding-up of the imbricated product stream, they are withdrawn from supply rolls which are arranged externally of the winding drum.

At the start of each winding operation the free ends of the winding bands must be manually connected with the hub of the winding drum. After completion of the winding operation the band ends are pulled tightly, in order to prevent opening of the product package during the subsequent transport and storage of the filled winding drum.

It is known that for a given diameter of the product package the length of the wound-up imbricated product formation, and thus, the required winding band length, is dependent upon the thickness of the products. This means that even in those instances when the product package upon the winding drum always possesses the same diameter there are required different winding band lengths. In order to be able to form in all instances a faultless wound package, it is for this reason necessary to always provide sufficient supply of the winding bands upon the supply rolls. Therefore, it can happen that after completion of a wound package there remains a winding band remainder upon the supply rolls. For the further processing of such winding band remainder there are basically available different possibilities.

Thus, for instance, the residual winding band length can be wound about the finished wound package. However, the completion of the wound package is then delayed by a time span which is dependent upon the length of the mentioned remainder of the winding bands. Additionally, the diameter of the wound package is enlarged by the amount of the additional layers or plies of the winding bands.

Apart from the foregoing it is also possible, after completion of the package, to cut the winding bands and to allow the winding band remaining portions to remain at the supply rolls. However, with such procedures problems then arise if the winding bands, after completion of the winding of the products by the winding drum, should again be reused for forming a new wound package. For the previously stated reasons it can happen that the winding bands which previously were shortened by cutting away a remaining portion no longer possess an adequate length for the formation of the new wound package. This then requires a time-consuming attachment of further band portions or sections.

Additionally, it is conceivable to allow the remaining portions of the winding bands to remain upon the supply rolls and to co-transport and co-store the latter along with the related finished wound package. However, as far as the handling operations which are involved such constitute extremely cumbersome procedures and additionally require manual work. These drawbacks become of importance because in a printing plant, as a general rule, an appreciable number of winding drums must be handled and stored.

SUMMARY OF THE INVENTION

Therefore, with the foregoing in mind it is a primary object of the present invention to eliminate, or at least considerably reduce, the previously explained drawbacks of the prior art solutions.

Another and more specific object of the present invention aims at the provision of a new and improved construction of a winding body for winding continuously arriving flat structures, especially printed products arriving in an imbricated product formation, as well as an improved winding apparatus utilizing such winding body for winding such flat structures, in a manner which is not associated with the aforementioned drawbacks and limitations of the prior art proposals.

Another and more specific object of the present invention aims at the provision of a new and improved construction of a winding body of the previously mentioned type which can be easily handled and without any time-consuming manipulations, and which furthermore allows for a non-problematic re-use of the wound band, even in those instances where different winding band lengths are required for different product packages.

Still a further significant object of the present invention is directed to a new and improved construction of winding body and winding apparatus using such winding body which is relatively simple in construction and design, extremely economical to manufacture, highly reliable in operation, not readily subject to breakdown or malfunction, and requires a minimum of maintenance and servicing.

Now in order to implement these and still further objects of the invention, which will become more readily apparent as the description proceeds, the winding body for the winding-up of continuously arriving flat structures, preferably printed products, which especially arrive in an imbricated product formation, and wherein there is interposed at least one winding band and where the winding body contains a substantially cylindrical outer surface or jacket, is manifested by the feature that internally of the jacket there is arranged a storage for the winding band. By means of a drive co-acting with the storage there can be removed and again stored, as the case may be, the winding band through an opening of the jacket.

When the winding body or core is empty the entire winding band length is housed internally of the winding body jacket or outer surface. Prior to winding-up of the printed products the storage can remove, by means of a drive, a winding band length which is exactly accommodated to the thickness of the products and the desired package diameter, and such can be infed to an intermediate storage, for instance a roll, arranged externally of the winding body. After completion of the wound package the intermediate storage is again emptied without there being present any excess winding band externally of the wound body or package. The intermediate storage can remain at the winding station and can be re-used during the formation of the next wound package. The winding band which remains unaltered throughout its entire length can be readily always re-used for packages of different diameter and/or products of different thickness. A further advantage resides in the fact that the entire winding operation can be accomplished automatically, that is to say, without resorting to any manual operations.

As already alluded to above the invention is not only concerned with the aforementioned novel construction of winding body, but also pertains to a new and improved construction of apparatus for winding flat structures, preferably printed products, which continuously arrive, especially in an imbricated product formation or array, while interposing at least one winding band, upon a winding body constructed according to the invention. Importantly, the winding apparatus is manifested by the features that there is provided an intermediate storage for receiving the winding band removed from the storage. This intermediate storage is arranged externally of the jacket or outer surface of the winding body.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
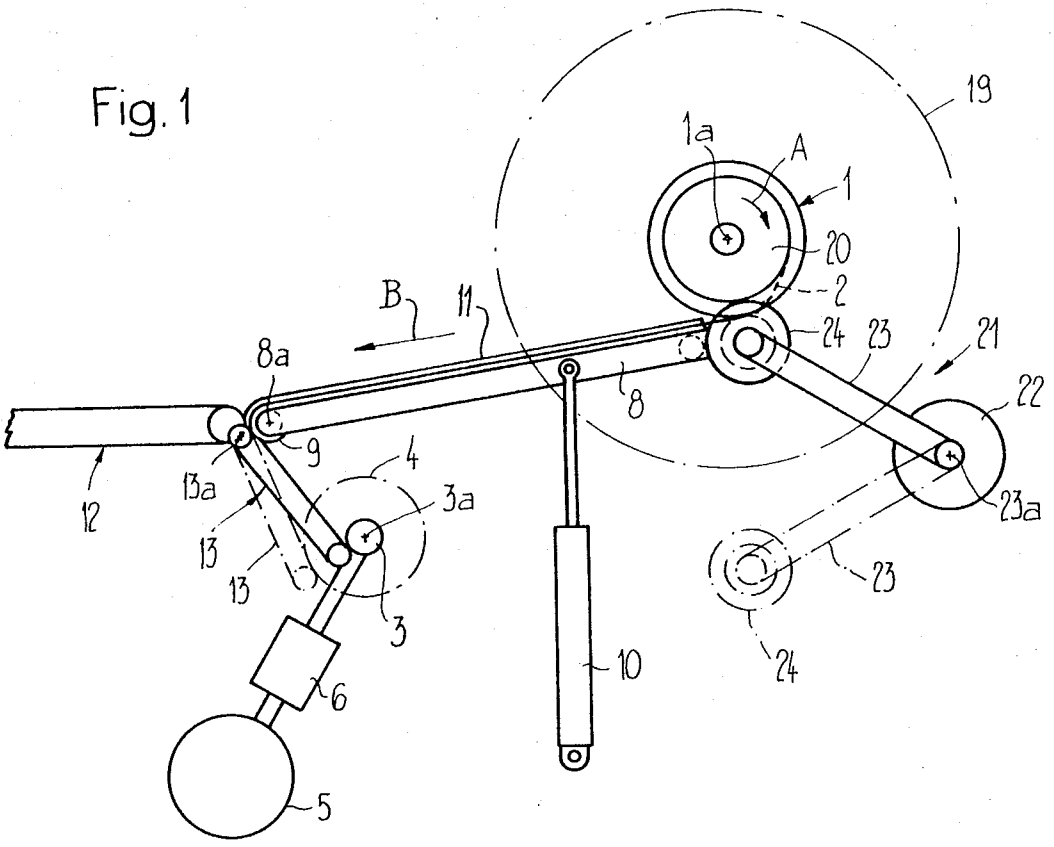
FIG. 1 illustrates an apparatus for winding-up an imbricated printed product formation upon a winding body in one of the working or operating phases.
Figure 2:
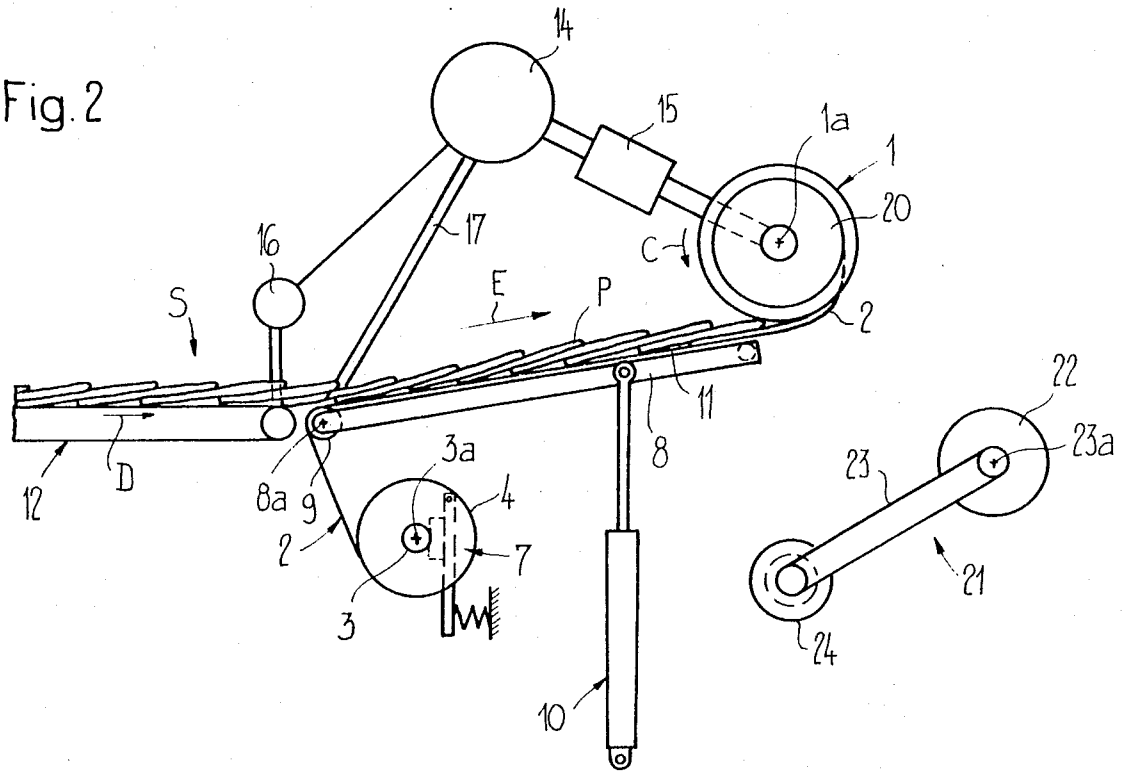
FIG. 2 illustrates the winding-up apparatus of FIG. 1 in a different working or operating phase.
Figure 3:
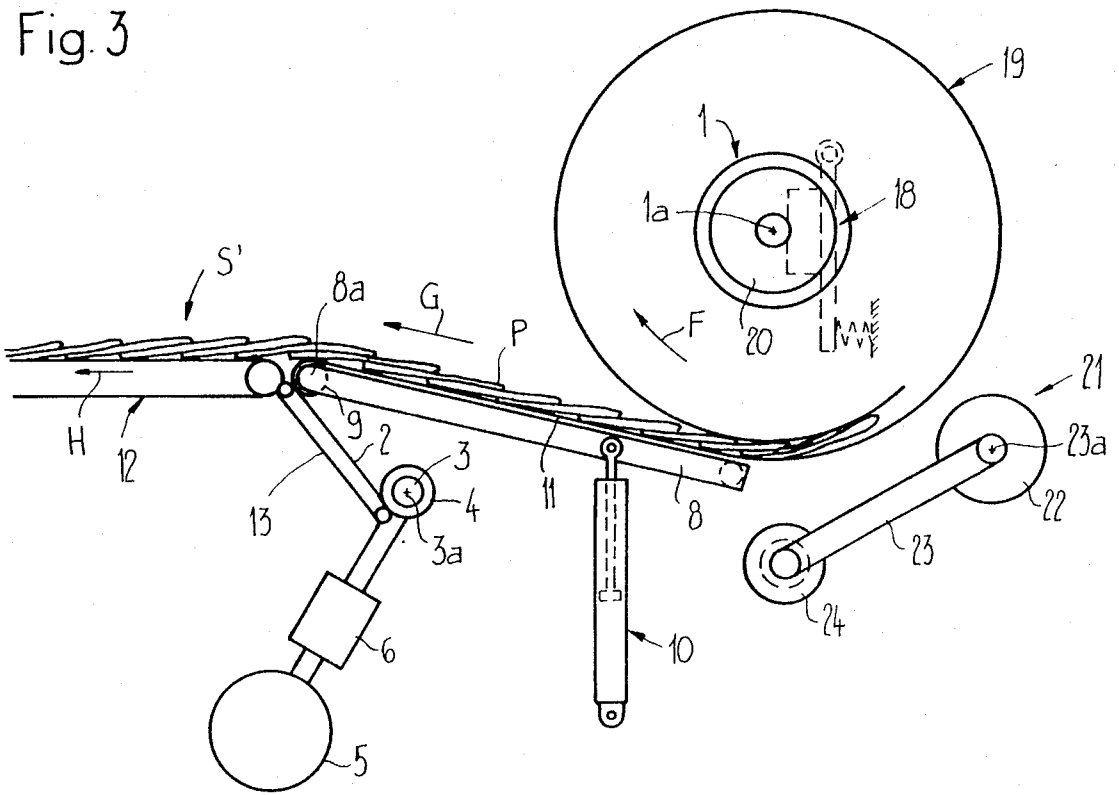
FIG. 3 illustrates an apparatus for winding-off the product formation from the winding body in a predetermined working or operating phase.
Figure 4:
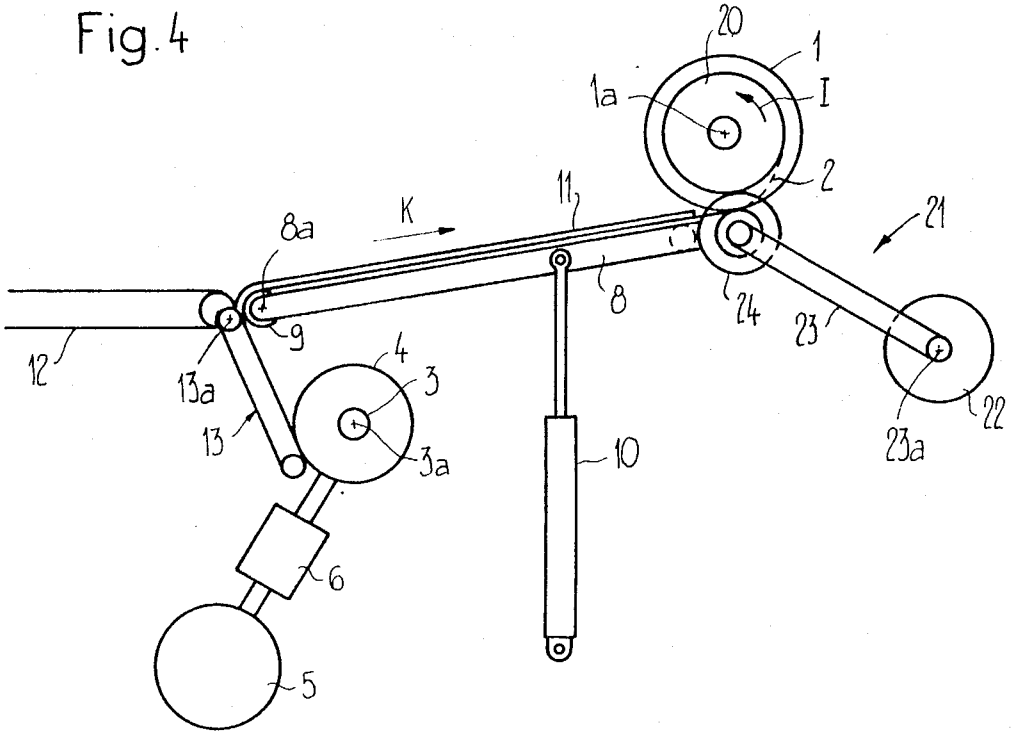
FIG. 4 illustrates the winding-off apparatus of FIG. 3 in a different operating or working phase.

Turning attention generally now to FIGS. 1 to 4, there has been illustrated purely schematically in FIGS. 1 and 2 a winding-up or winding apparatus and in FIGS. 3 and 4 a winding-off or unwinding apparatus in different operating or working phases thereof. In the description to follow it is assumed that the winding or winding-up apparatus and the winding-off or unwinding apparatus essentially are constituted by the same apparatuses. It is for this reason that in FIGS. 1 to 4 there have been generally employed the same reference characters to denote the same or analogous components. However, it should be understood that there could be used also different pieces of equipment for the winding-up and winding-off operations.

Initially, it is to be mentioned that the apparatuses depicted in FIGS. 1 to 4 correspond in their construction and also in their mode of operation extensively to the equipment disclosed in German Patent Publication No. 3,123,888 and the corresponding British Patent Publication No. 2,081,230 and the aforementioned co-pending U.S. application Ser. No. 06/280,998, to which reference may be readily had and the disclosure of which is incorporated herein by reference.

In order to wind-up the printed products P arriving in an imbricated product formation or array S there is utilized an only schematically illustrated winding body or core 1, the construction of which will be described more fully hereinafter. This winding body 1 is rotatably mounted about a shaft 1*a*. In order to take-up a winding band or tape 2 or equivalent structure, which is stored in the winding body 1 in a manner to be likewise more fully described hereinafter, there is provided a spool member 3 which is arranged externally of the winding body 1 and which is mounted to be rotatable about an axis of rotation 3*a*. The package which is formed upon the spool member 3 by spooling or winding-up the winding band 2 has been generally designated by reference numeral 4. In order to form this package 4 the spool member 3 is driven by a drive motor 5 by means of a conventional winder gearing or transmission system 6. As best seen by referring to FIG. 2, during the unwinding of the winding band 2 from the spool member 3 this spool member is braked by a jaw brake 7 or equivalent brake structure. Arranged between the winding body 1 and the spool member 3 is a rocker or balance member 8 which is pivotable about a pivot axis 8*a*. At this rocker member 8 there is arranged a not particularly illustrated band or belt conveyor of conventional design. Furthermore, there is mounted at the rocker or balance member 8 a deflection roll 9 for the winding band 2 and which is rotatable about the pivot axis 8*a*. Engaging with the rocker member 8 is a contact or pressure mechanism 10 which is provided with a standard spring storage, this contact or pressure mechanism 10 upwardly pressing the rocker or balance member 8 against the winding body 1 or the wound product package formed thereupon, as the case may be. This rocker or balance member 8 is provided at its upper side with a merely schematically illustrated guide arrangement or guide means 11 for the winding band 2.

Merging with the rocker or balance member 8 is a band or belt conveyor 12 or equivalent conveyor device which can be driven in any suitable and therefore not particularly illustrated fashion. Between the deflection roll 9 and the spool member 3 there is arranged a further rocker or balance member 13, as best seen by referring to FIGS. 1, 3 and 4, which is pivotable about an axis 13*a*. This rocker or balance member 13 serves for guiding the winding band 2 which inbounds at the spool member 3. Mounted in this rocker or balance member 13 is a not particularly illustrated band or belt conveyor or equivalent conveying structure.

In order to wind-up the imbricated product formation or array S upon the winding body 1 such must be driven. As best seen by referring to FIG. 2, there is provided for this purpose a drive motor 14 which is connected in driving relationship with the winding body 1 by means of a winding gearing 15 of known construction. The drive motor 14 receives control signals from a tachogenerator 16 which is driven by the band or belt conveyor 12. Additionally, by means of the merely schematically illustrated drive connection 17 the drive motor 14 drives the deflection roll or roller 9.

During the winding-off of the imbricated product stream S' from the product package 19 located upon the winding body 1 this winding body 1 is decoupled from the drive motor 14. For that purpose a jaw brake 18 or equivalent brake structure engages at the winding body 1, as the same has been clearly illustrated in FIG. 3.

As will be still further more fully explained hereinafter internally of the winding body 1 there is accommodated a supply spool 20 for the winding band or tape 2 and which only has been schematically illustrated in FIGS. 1 to 4. For unwinding the winding band 2 from the supply spool 20 and for winding-up this winding band 2 upon such supply spool 20 there is provided a conventional drive device 21 which has therefore only been schematically illustrated. This drive device or drive means 21 contains a drive motor 22 which drives a not particularly illustrated drive element, for instance a belt or a chain, which is mounted at a pivotable arm member 23. This pivotable arm or arm member 23, which can pivot about the pivot shaft 23*a* carries at its free end a drive roll 24 defining a drive member and which is constructed as a friction wheel. This drive roll 24 is driven by the drive motor 22 by means of the aforementioned drive element. In the lower terminal or end position of the pivotable arm member 23, depicted in FIGS. 1 and 3, the drive device or drive means 21 does not have any effect upon the supply spool 20. In order to drive this supply spool 20 the pivotable arm member 23 is rocked into the upper terminal or end position depicted in FIGS. 1 and 4, where the drive roll 24 is then in driving contact or connection with the supply spool 20.

Figure 5:
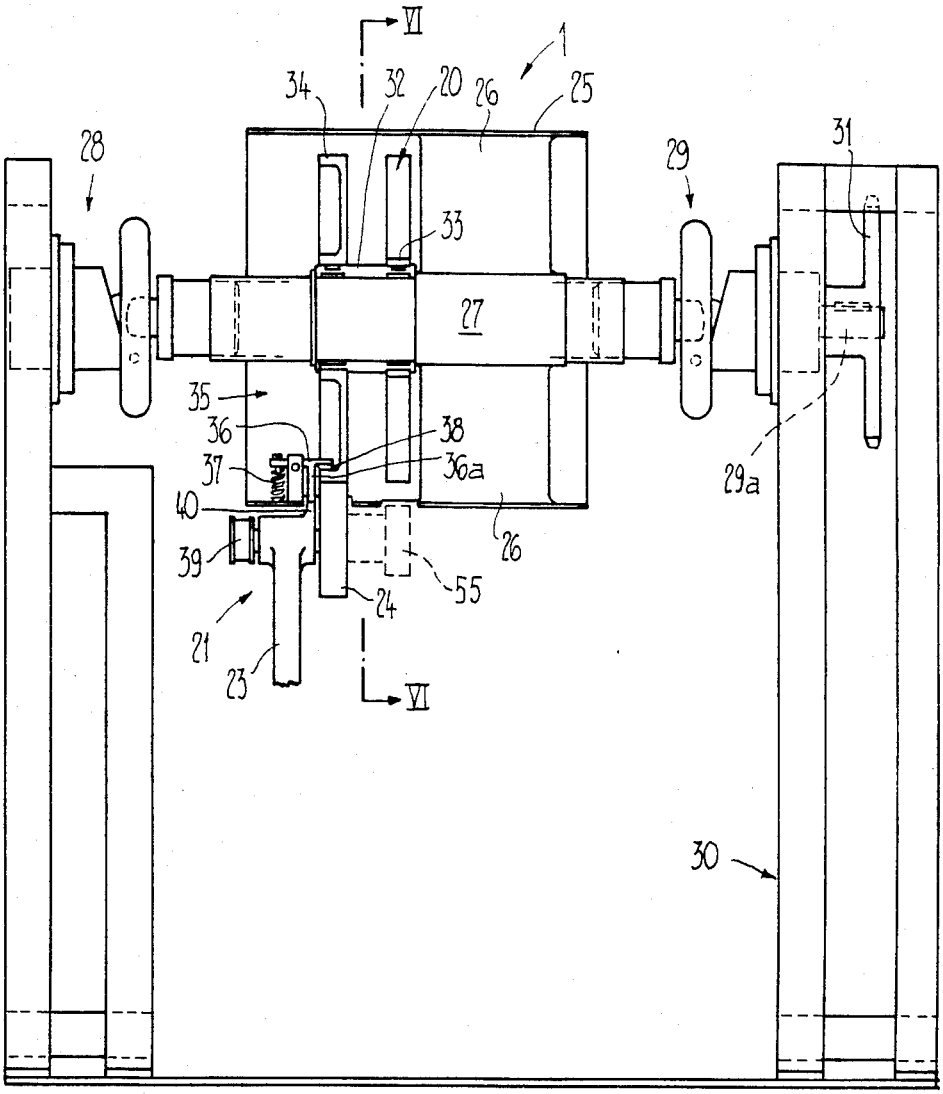
FIG. 5 is a side view, partially in section, of a winding body mounted in a frame arrangement.

Based upon the illustration of FIG. 5 there will be now more fully explained the construction and mounting of the winding body 1. As will be apparent from such FIG. 5, which shows the winding body 1 in sectional view, this winding body 1 possesses a cylindrical outer surface or jacket 25 which serves as a winding drum. This jacket or outer surface 25 is rigidly connected for rotation by means of the rib members 26 with a mounting shaft 27. This shaft 27 is mounted at its ends in flap bearings 28 and 29 or equivalent structure and which are of known design. These flap bearings 28 and 29 are retained at a frame arrangement 30 supported upon the floor. Upon a stub shaft 29*a* of the flap bearing 29 there is seated a drive gear 31 which can be operatively coupled with the winder gearing 15.

Mounted upon the shaft 27 and rotatable in relation thereto is a hub member 32 upon which there is seated the spool core 33 of the supply spool 20 and a drive wheel 34 defining a drive element. The spool core 33 and the drive wheel 34 are rigidly connected for rotation with the hub member 32, for instance by means of a wedge and key connection or any other equivalent connection facility. Acting upon the drive wheel 34 is a brake device 35 which contains a pivotably mounted double-arm lever 36. The one lever arm of this double-arm lever or lever member 36 bears upon a pressure or compression spring 37, whereas the other lever arm thereof carries a brake lining 38 which rs applied by means of the spring 37 against the drive wheel 34 and prevents rotation of the drive wheel 34 and the supply spool 20. In FIG. 5 there has been illustrated a portion of the drive device 21 which is located in its drive position. At the end of the pivotal arm 23 there is mounted a deflection roll 39 over which there is guided the not particularly illustrated drive element and which is rigidly connected for rotation with the drive roll 24. This drive roll 24 is in frictional contact with the circumference of the drive wheel 34. The pivotable arm or arm member 23 is provided with a projection or protuberance 40 which acts upon an extension 36*a* provided at the lever member 36 and upwardly rocks such against the force of the spring 37. Consequently, the brake lining 38 is lifted-off the drive wheel 34.

Figure 6:
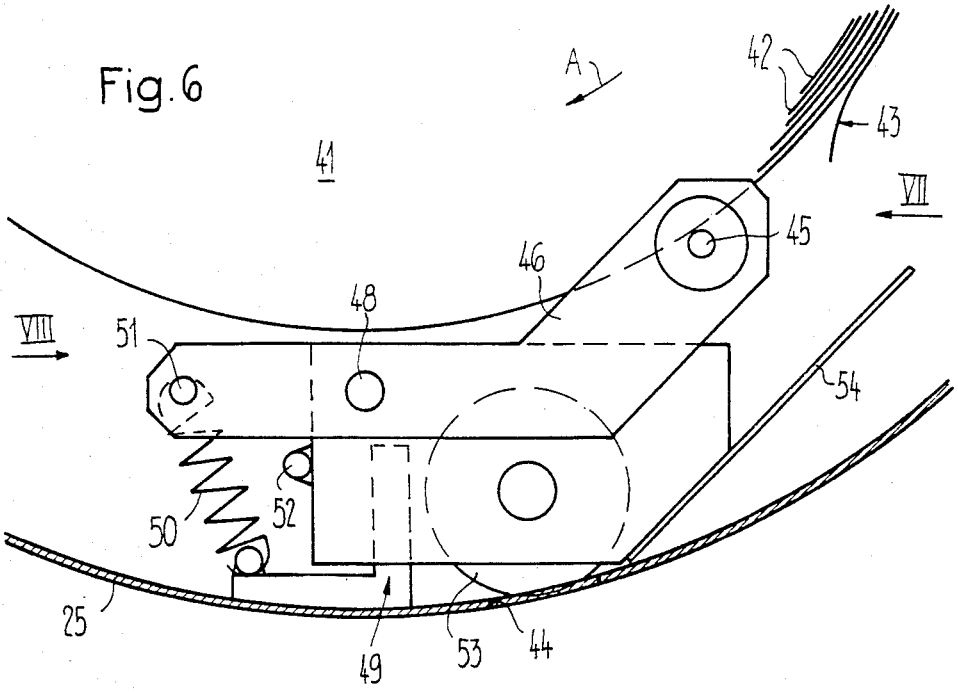
FIG. 6 illustrates the lower portion of the winding body in a sectional view, taken substantially along the section line VI—VI of FIG. 5.

In FIG. 6 there has been illustrated in sectional view, taken substantially along the line VI—VI of FIG. 5, and on an enlarged scale, a lower portion of the winding body 1. As to the supply spool 20 there has been illustrated a portion of the package 41, and the individual winding layers or plies 42 of the winding band or tape 2 have been indicated. The end of the winding band 2 has been designated by reference numeral 43. In order to render possible the outfeed of the winding band or tape 2 from the jacket or outer surface 25 this jacket 35 is provided with a suitable opening or slot 44.

Figure 8:
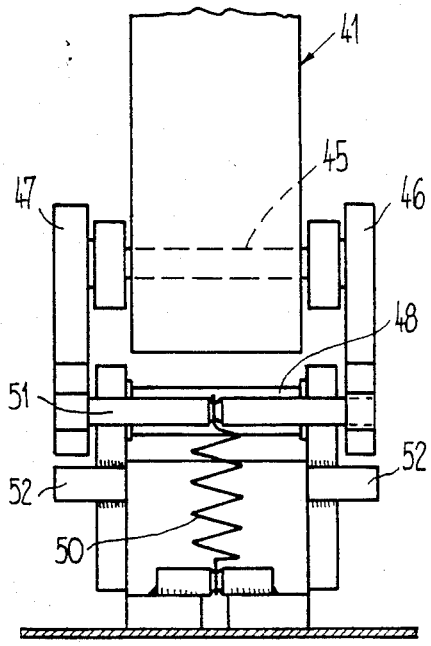
FIGS. 7 and 8 respectively illustrate side views of the winding body depicted in FIG. 6 looking in the direction of the arrows VII and VIII, respectively.
Figure 7:
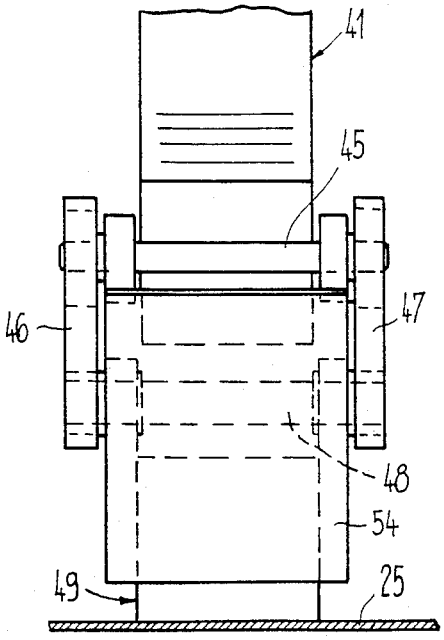

In order to ensure for a detachment of the band end 43 from the band package 41 during rotation of the supply spool 20 in the direction of the arrow A, there is provided a pin member 45 which bears at the circumference of the band package 41. This pin member 45 is mounted in two levers or lever members 46 and 47 which are arranged laterally of the band package 41, as best seen by referring particularly to FIGS. 7 and 8. These lever members 46 and 47 are affixed to a shaft 48 which is mounted in a holder device 49 attached at the inner side of the jacket or outer surface 25. At the other end of the levers 46 and 47 there engages a tension or traction spring 50 or equivalent structure. This tension spring 50 is anchored at one end at the holder device 49 and is connected at its other end with a bolt member 51 which is supported by the levers 46 and 47. Additionally, there are mounted stops or impact members 52 at the holder device 49. These stops 52 limit the pivotal movement of the levers or lever members 46 and 47.

Furthermore, a roll 53 is rotatably mounted in the holder device 49. This roll or roller member 53 is arranged at the region of the band feed opening or slot 44 provided in the jacket or outer surface 25. At the holder device 49 there is additionally arranged a guide means or guide arrangement 54 which extends towards the aforementioned opening 44 and in conjunction with the roll or roller member 53 serves to guide the band end 43 which has been detached from the band package 41 towards the feed opening or slot 44 and to also insert such through such feed opening 44, as such has been illustrated in conjunction with FIGS. 9 and 10.

Figure 9:
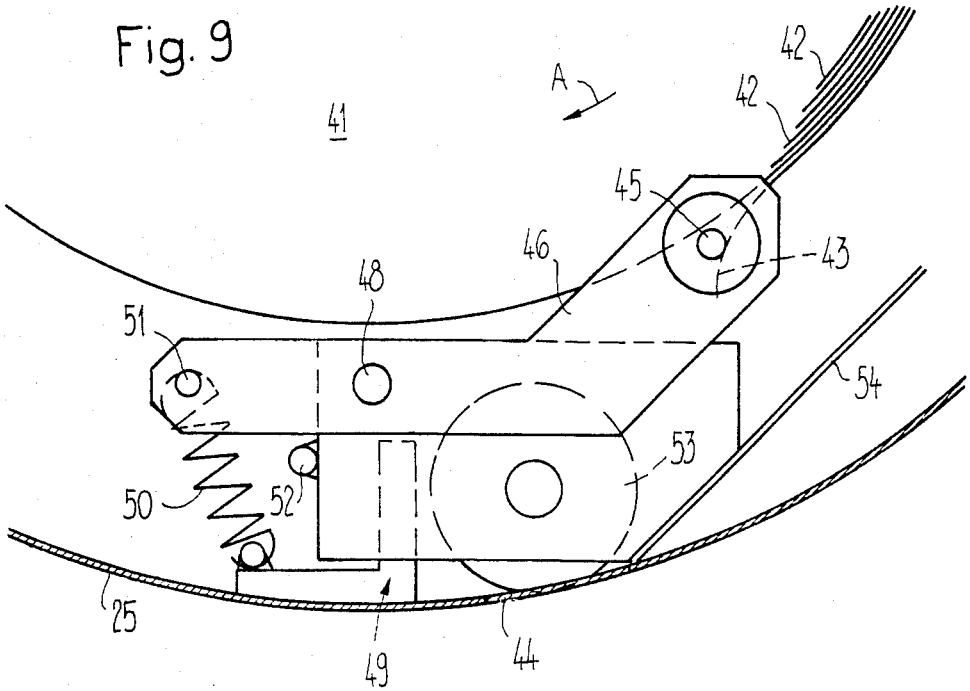
FIGS. 9 and 10 illustrate different phases of the winding-off operation of the winding band in an illustration corresponding to the showing of FIG. 6.
Figure 10:
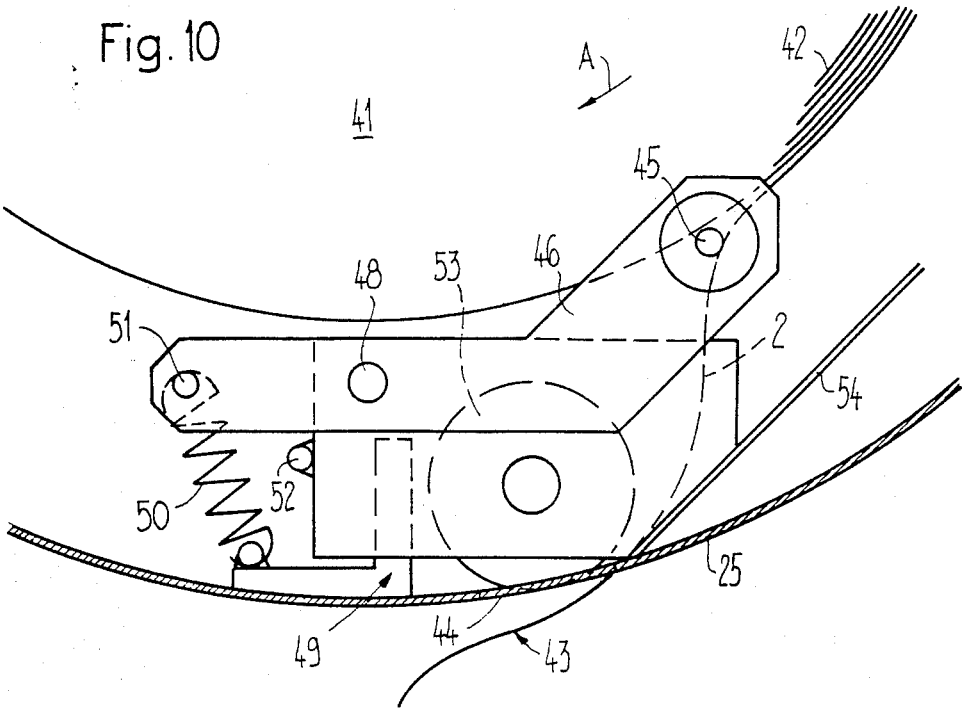

If by driving the drive wheel 34, as shown in FIG. 5, the band spool 20 is rotated in the direction of the arrow A, as best seen by referring to FIGS. 6, 9 and 10, then the band end 43 is detached from the band package 41 by the pin member 45, as illustrated in FIG. 9. During the further rotation of the band supply spool 20 the band end 43 impacts against the guide means or guide arrangement 54 and is conducted by such and the roll 53 towards the feed opening or slot 44 and pushed through such opening 44.

Figure 11:
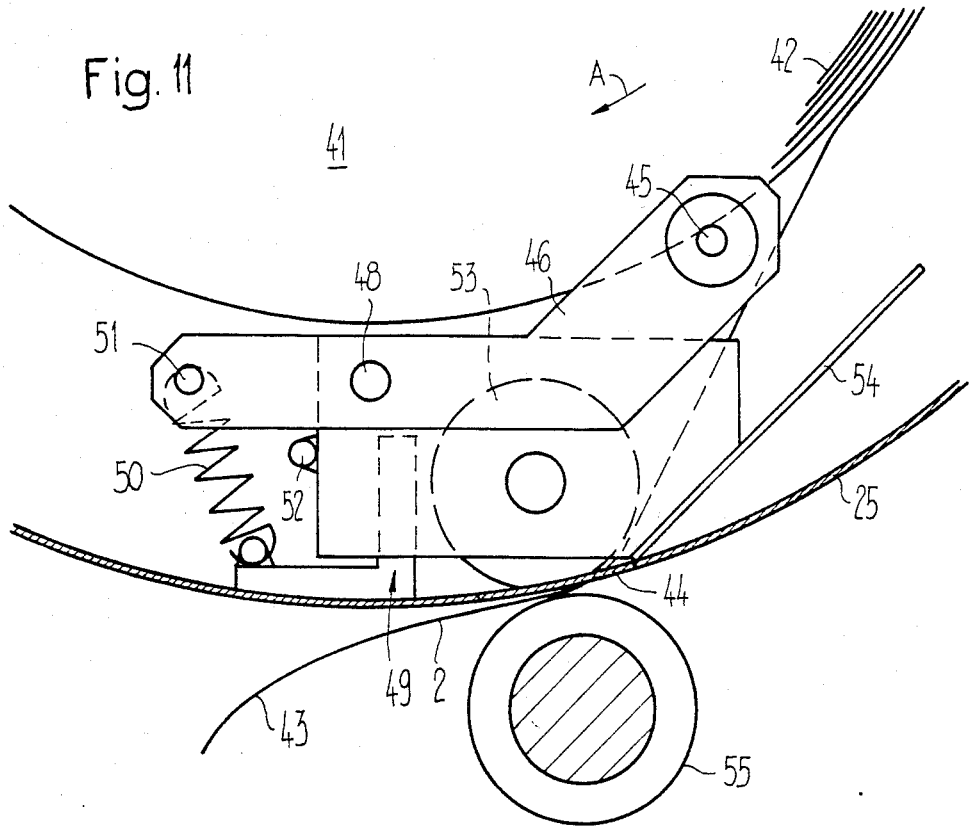
FIG. 11 illustrates a variant construction for the withdrawal or winding-off of the winding band and in an illustration corresponding to the showing of FIG. 6.

Under circumstances such ejection of the winding band or tape 2 through the opening or slot 44, and caused by the rotation of the band supply spool 20, must be augmented by a band feed or advance device. Such feed or advance device has been illustrated in FIG. 11 and will be discussed in conjunction therewith. Coacting with the roll or roll member 53 is a driven conveyor roll 55 which, as shown in phantom or broken lines in FIG. 5, is rigidly connected for rotation with the drive roll 24 for the drive wheel 34. The rolls 53 and 55 form a pair of feed or advance rolls between which there is guided the winding band or tape 2 which passes through the feed opening or slot 44.

Figure 12:
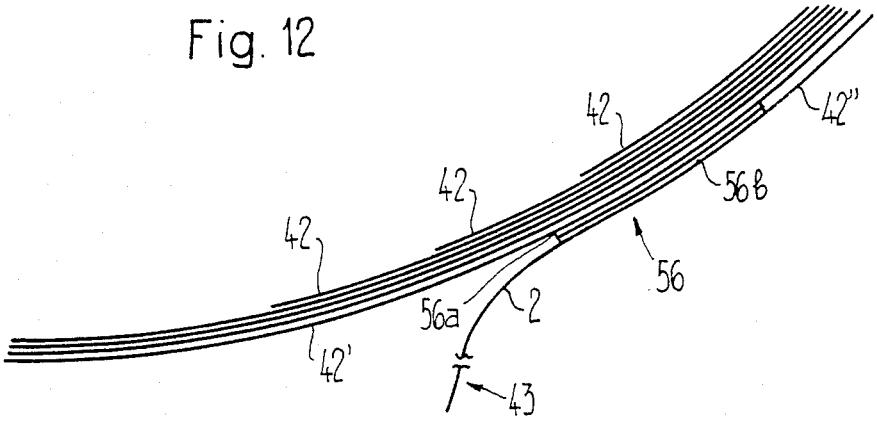
FIG. 12 illustrates a portion of the winding band roll together with the band end.

When the winding band 2 has been completely wound onto the supply spool 20 there must be undertaken measures in order to prevent any unintentional detachment of the winding band end 43 from the band or tape package 41. In FIG. 12 there is schematically illustrated one possible construct:on of a connection facility between both of the outermost winding layers or plies 42' and 42''. Both of these outermost winding layers or plies 42' and 42'' are retained against one another by means of a so-called burr or interlooping closure 56, also known in the art as a "VELCRO" fastener. For this purpose the winding band or tape 2 is provided with two closure or fastener portions **56*a* and 56*b*, of which the one is provided in known manner with closure loops and the other with closure hooks which interengage with one another. As depicted in FIG. 12 the one closure or fastener portion 56*a* is arranged at the second outermost winding layer 42' and the other closure or fastener portion 56*b* is arranged at the outermost winding layer or ply 42''**.

Since there is required a certain force for mutually separating from one another both of the closure portions or parts **56*a* and 56*b*, as a general rule contact of the burr or interlooping closure device 56 with the pin member 45 is not sufficient for opening such burr closure device 56. In this case it is therefore necessary, as has been illustrated in FIG. 11, to provide the aforedescribed feed or advance device 53, 55. The closure portion 56*b* which is attached with the outermost winding layer or ply 42'' is arranged at such a spacing behind the end of the winding band or tape 2 so that the band end 43 protruding past this closure portion 56*b* can be engaged by both of the rolls or roller members 53 and 55. By means of the traction produced in the winding band 2 by the action of the feed rolls 53 and 55 the two burr or interlooping closure portions 56*a* and 56*b*** can be effectively separated from one another.

It should be understood that the releasable connection between both of the outermost winding layers or plies 42' and 42'' also can be constructed in a different manner. In particular, the end portion 43 of the winding band or tape 2 can be fabricated from a magnetic material or can be provided with a magnet element. The portion of the winding band 2 which merges with the band end must consist of a magnetizable material, for instant steel, over a length which is greater than the length of the circumference of the finished band or tape package 41. With such type of solution the band end 43 bears by magnetic force against the band package 41. The detachment of this magnetically retained band end 43 can be accomplished by the action of the pin member 45 in the manner described previously in conjunction with FIGS. 9 and 10.

Figure 13:
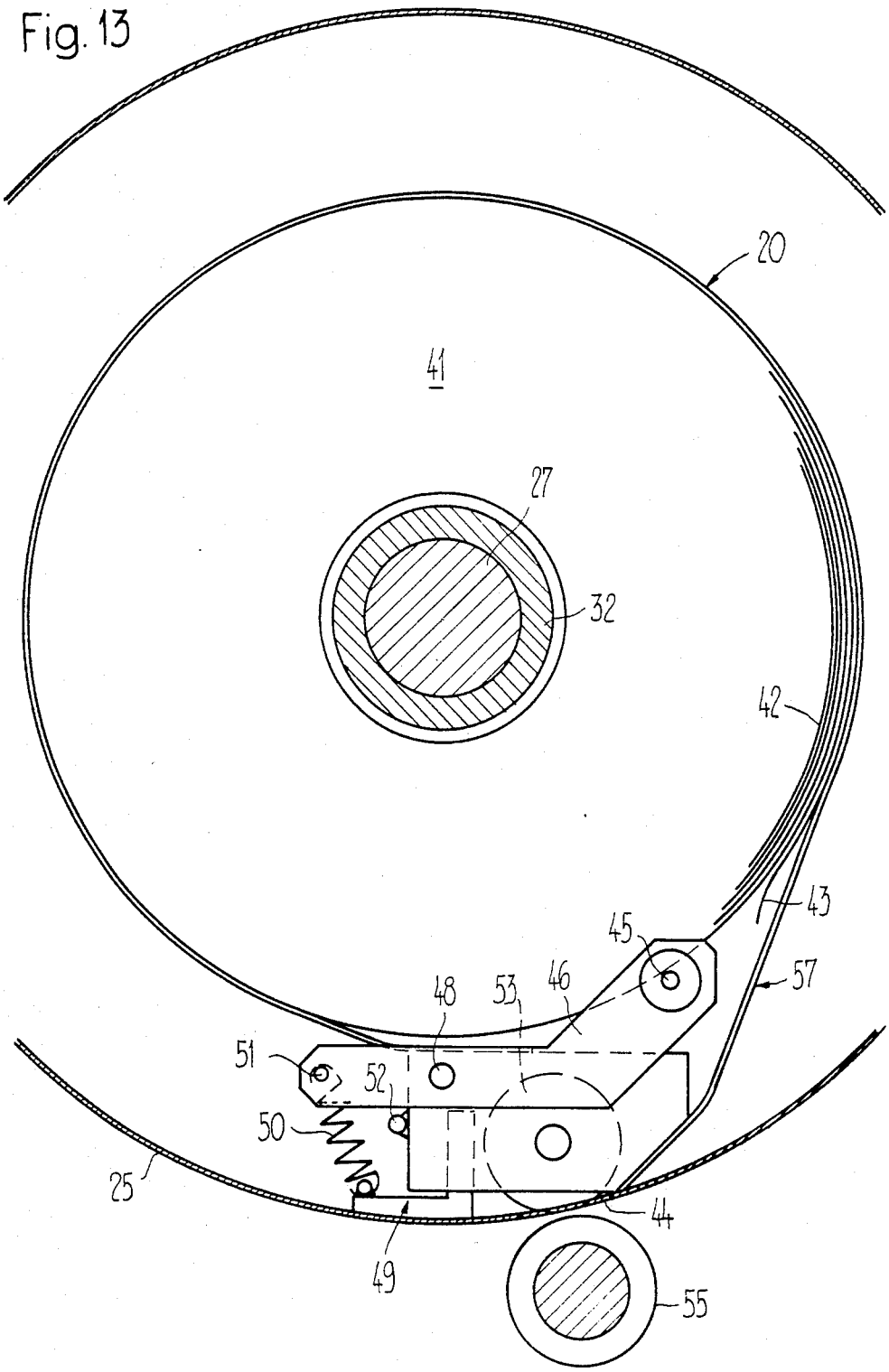
FIG. 13 is a side view of a further embodiment of a winding body and essentially in sectional view taken substantially along the section line VI—VI of FIG. 5.

As best seen by referring to FIG. 13, it can be necessary, under circumstances, to provide a guide band 57 which is attached at the holder device 49, this guide band 57 wrapping about the finished band package 41 over an appreciable portion of its circumference. This guide band 57 serves for radially limiting the package 41 and assumes the task of guiding the winding band or tape 2 during winding-up of the winding band 2 upon the spool core 33.

Based upon the illustration of FIGS. 1 to 4 there will be now be explained the winding-up and winding-off of the imbricated product stream S and S' respectively.

Prior to the start of the actual winding operation the winding band 2 is paid-off of the supply spool 20 by means of the drive device or drive means 21, as such has been described in conjunction with FIGS. 6 to 12. As best seen by referring to FIG. 1, the winding band or tape 2 departing through the feed opening or slot 44 in the jacket or outer surface 25 is displaced by the action of the guide means 11 located at the rocker member 8 towards the spool member 3. The band or tape 2 travels over the deflection roll 9 and is guided by the other rocker member 13 to the circumference of the spool member 3. The leading end of the winding band or tape 2 is attached in a suitable fashion to the spool member 3, for instance by means of a burr fastener or closure element or by magnetic adhesion, as such has been previously explained in conjunction with FIG. 12. As soon as the end of the winding band 2 is connected with the spool member 3 this spool member 3 is placed into rotation by the drive motor 5. The drive means 21 which rotates the supply spool 20 in the direction of the arrow A and forwardly feeds the winding band 2 in the direction of the arrow B remains turned-on for such length of time until the spool member 3 has wound-up thereon a number of band coils or windings. Then this drive means 21 is turned-off by pivoting away the drive roll 24 into the position depicted in phantom or broken lines in FIG. 1. The winding-up of the winding band or tape 2 upon the spool member 3 now is accomplished exclusively by driving the spool member 3. As has been illustrated in FIG. 1 in phantom or broken lines the rocker or balance member 13 follows the band package 4 which increases in size. As soon as the band length needed for forming the next product package upon the winding body 1 has been wound upon the spool member 3 the drive motor 5 is turned-off. The detection of the length of the winding band or tape 3 which has been wound-up upon the spool member 3 can be accomplished in any suitable and therefore not particularly illustrated fashion, for instance by appropriately sensing the diameter of the band package 4.

The apparatus is now ready for winding-up the printed products P which arrive in an imbricated product formation S. As shown in FIG. 2, this imbricated product formation S is infed by the band conveyor 12, driven in the direction of the arrow D, and is delivered by means of the rocker or balance member 8 to the winding body or core 1. This winding body or core 1 is driven by the drive motor 14 in the direction of the arrow C. The supply spool 20 is blocked by the brake device 35, shown in FIG. 5, and therefore co-rotates along with the jacket or outer surface 25. By means of the driven winding body or core 1 the winding band or tape 2 together with the printed products P bearing thereon are wound-up onto the jacket or outer surface 25. The spool member 3 is braked by the jaw brake 7 during the product winding-up operation, so that the winding band or tape 2 is wound onto the jacket or outer surface 25 while under tension. The winding-up operation basically is accomplished in the manner described in detail in the previously mentioned German Patent Publication No. 3,123,888 and the corresponding British Patent Publication No. 2,081,230 and the aforementioned copending U.S. application Ser. No. 06/280,998.

At the end of the winding operation the winding band 2 is wrapped one or a number of times about the finished product package 19, in order to ensure for a firm retention of the product package 19 during its subsequent handling. Of course, the end of the winding band or tape 2 can be also releasably retained upon the neighboring package layer or ply in the manner previously explained in conjunction with the illustration of FIG. 12. The finished package 19 then can be removed out of the flap bearings or mounts 28 and 29, depicted in FIG. 5, and can be transported away in order to be further processed or intermediately stored. Since the entire winding band 2 which previously was wound upon the spool member 3 was needed for forming the product package 19, this spool member 3 now is empty and ready for taking-up the winding band 2 of the next winding body or core 1.

The winding-off of a product package 19, which likewise has been more fully explained in the aforementioned German Patent Publication No. 3,123,888 and the cognate British Patent Publication No. 2,081,230 and the copending U.S. application Ser. No. 06/280,998, will be now described based upon FIGS. 3 and 4.

After inserting a full winding body 1 into the flap bearings 28 and 29 the end of the winding band 2 is engaged by the band conveyor arranged at the rocker or balance member 8 and driven in not particularly illustrated fashion and then such seized winding band 2 is moved in the direction of the arrow G along the rocker member 8 towards the deflection roll 9. Thereafter, the band end is moved by the rocker or balance member 13 towards the spool member 3, with which it is connected in the manner already previously described in conjunction with the description of the illustration of FIG. 1. By driving the spool member 3 by means of the drive motor 5 there is now wound the winding band or tape 2 onto the spool member 3. This now has the result that the winding body or core 1, while being braked by the brake device 18, is rotated in the direction of the arrow F, and the imbricated product formation S′ is wound-off of the product package 19 and guided over the rocker or balance member 8 to the band conveyor 12. This band conveyor 12 is driven in any suitable fashion in the direction of the arrow H, and thus, conveys away the wound-off imbricated product formation or stream S′.

After completion of the winding-off of the imbricated product formation S′ the winding band 2 which has now been wound upon the spool member 3 must again be wound back. For this purpose the pivotable or pivotal arm member 23 of its drive device 21 again must be upwardly pivoted into the drive position, as the same has been depicted in FIG. 4. By driving the drive roll 24 by means of the drive motor 22 the drive wheel 34 and along therewith the spool core 33 (FIG. 5) is driven in the direction of the arrow I. Consequently, the winding band or tape 2 is wound-off of the spool member 3 and drawn in the direction of the arrow K towards the winding body 1 and wound upon the supply spool 20.

With the previously described solution the winding band or tape 2 is always co-transported and co-stored throughout its entire length along with the winding body 1. Thus, the winding band 2 is either wound-up throughout its entire length upon the supply spool 20 or forms with at least a portion of its length the separation or partition layers between the coils or windings of the product package 19. The outfeed of the winding band 2 from the supply spool 20 and the rewinding of the winding band 2 upon such supply spool 20 can be automatically accomplished. Since in each case there is only wound-off of the supply spool 20 the band length needed for forming a product package 19, after completion of formation of the product package 19 there is not formed upon the spool member 3 any band remaining portion. The winding band 2 can then be readily re-used without any difficulties, and specifically, for packages where there are required different winding band lengths.

While there are shown and described present preferred embodiments of the invention, it is to be distinctly understood that the invention is not limited thereto, but may be otherwise variously embodied and practiced within the scope of the following claims.

Accordingly, what I claim is:

1. A winding body arrangement for winding-up continuously arriving substantially flat structures, particularly printed products, especially arriving in an imbricated product stream, comprising:

a winding body having a substantially cylindrical jacket;

at least one winding band interposed at the wound-up imbricated product stream;

storage means for the winding band arranged internally of said jacket of said winding body;

said jacket having an opening for the infeed and outfeed of said winding band;

drive means for outfeeding and again infeeding for storage at said storage means the winding band through said opening of said jacket of said winding body;

said storage means comprises a rotatably mounted and arrestable band spool which can be operatively coupled with said drive means;

a rotatable drive element with which there is rigidly connected for rotation said band spool; and a drive member for driving said drive element.

2. The winding body arrangement as defined in claim 1, wherein:

said winding band when completely wound onto said band spool forms a band package and having its free end releably connected with said band package.

3. The winding body arrangement as defined in claim 1, further including:

a mounting shaft with which there is operatively connected said jacket; and said band spool being freely rotatably mounted upon said mounting shaft.

4. The winding body arrangement as defined in claim 1, further including:

a brake device effective upon said drive element or said band spool; and said brake device being releasable upon operatively intercoupling said drive element and said drive member.

5. The winding body arrangement as defined in claim 1, further including:

a brake device effective upon said drive element and which can be released upon operatively intercoupling said drive element and said drive member.

6. The winding body arrangement as defined in claim 1, further including:

a brake device effective upon said band spool and which can be released upon operatively intercoupling said drive element and said drive member.

7. The winding body arrangement as defined in claim 1, wherein:

said drive member comprises a driven friction wheel which can be operatively applied to said drive element; and a pivotable arm member at which there is mounted said driven friction wheel.

8. The winding body arrangement as defined in claim 4, wherein:

said drive member comprises a driven friction wheel;

a pivotable arm member at which there is mounted said driven friction wheel;

said driven friction wheel being capable of being placed into contact with said drive element; and said brake device comprising a jaw brake which can be opened by the pivotable arm member supporting said friction wheel when said friction wheel is in contact with said drive element.

9. A winding body arrangement for winding-up continuously arriving substantially flat structures, particularly printed products, especially arriving in an imbricated product stream, comprising:

a winding body having a substantially cylindrical jacket;

at least one winding band interposed at the wound-up imbricated product stream;

storage means for the winding band arranged internally of said jacket of said winding body;

said jacket having an opening for the infeed and outfeed of said winding band;

drive means for outfeeding and again infeeding for storage at said storage means the winding band through said opening of said jacket of said winding body;

said storage means comprises a rotatably mounted and arrestable band spool which can be operatively coupled with said drive means;

said winding band when completely wound onto said band spool forms a band package and having its free end releasably connected with said band package; and means for generating a magnetic force for retaining the winding band at a free end thereof at the band package.

10. A winding body arrangement for winding-up continuously arriving substantially flat structures, particularly printed products, especially arriving in an imbricated product stream, comprising:

a winding body having a substantially cylindrical jacket;

at least one winding band interposed at the wound-up imbricated product stream;

storage means for the winding band arranged internally of said jacket of said winding body;

said jacket having an opening for the infeed and outfeed of said winding band;

drive means for outfeeding and again infeeding for storage at said storage means the winding band through said opening of said jacket of said winding body;

said storage means comprises a rotatably mounted and arrestable band spool which can be operatively coupled with said drive means;

said band spool having the winding band wound thereon to form a band package; and a release element bearing at the circumference of the band package when the winding band has been completely wound onto the band spool in order to raise an end of the winding band from the band package.

11. The winding body arrangement as defined in claim 10, further including:

guide means for delimiting the band package in radial direction thereof; and said guide means extending along the circumference of the band package.

12. The winding body arrangement as defined in claim 10, further including:

a withdrawal device for withdrawing the winding band from the band package.

13. The winding body arrangement as defined in claim 12, wherein:

said withdrawal device comprises two rolls arranged at the region of said opening at the jacket; and one of said rolls comprising a driven roll.

14. The winding body arrangement as defined in claim 13, further including:

a rotatable drive element for said band spool;

a drive member for driving said drive element;

said drive member comprises a driven friction wheel which can be applied to said drive element;

a pivotable arm member at which there mounted said driven friction wheel;

said one driven roll being rotatably mounted internally of said jacket; and said driven roll being rigidly connected for rotation with said friction wheel.

15. A winding body arrangement for winding-up continuously arriving substantially flat structures, particularly printed products, especially arriving in an imbricated product stream, comprising:

a winding body having a substantially cylindrical jacket;

at least one winding band interposed at the wound-up imbricated product stream;

storage means for the winding band arranged internally of said jacket of said winding body;

said jacket having an opening for the infeed and outfeed of said winding band;

drive means for outfeeding and again infeeding for storage at said storage means the winding band through said opening of said jacket of said winding body;

said storage means comprises a rotatably mounted and arrestable band spool which can be operatively coupled with said drive means;

said winding band when completely wound onto said band spool forms a band package and having its free end releasably connected with said band package; and a burr closure device effective between both outermost winding layers of the band package for forming a releasable connection.

16. An apparatus for winding-up continuously arriving substantially flat structures, preferably printed products, especially arriving in an imbricated product stream, comprising:

a winding body having a substantially cylindrical jacket;

at least one winding band capable of being interposed at the imbricated product stream;

storage means for the winding band arranged internally of said jacket;

said jacket having an opening for the infeed and outfeed of said winding band;

drive means for outfeeding and again infeeding for storage upon the storage means the winding band through said opening of said jacket of said winding body;

said storage means comprises a rotatably mounted and arrestable band spool which can be operatively coupled with said drive means;

a mounting shaft with which there is operatively connected said jacket;

said band spool being freely rotatably mounted upon said mounting shaft;

an intermediate storage for the take-up of the winding band removed from the storage means; and said intermediate storage being arranged externally of the jacket of the winding body.

17. The apparatus as defined in claim 16, further including:

guide means for the winding band provided between the winding body and the intermediate storage.

18. The apparatus as defined in claims 16 or 19, wherein:

said intermediate storage contains a driveable and brakeable spool member.

* * * * *

UNITED STATES PATENT AND TRADEMARK OFFICE

CERTIFICATE OF CORRECTION

PATENT NO. : 4,532,750

DATED : August 6, 1985

INVENTOR(S) : JACQUES MEIER

It is certified that error appears in the above—identified patent and that said Letters Patent is hereby corrected as shown below:

Column 6, line 21, please delete "rs" and replace it with --is--

Column 11, line 3, please delete "releably" and replace it with --releasably--

Column 14, line 22, please delete "19" and replace it with --17--

Signed and Sealed this

*Nineteenth* Day of *November 1985*

[SEAL]

*Attest:*

DONALD J. QUIGG

*Attesting Officer*

*Commissioner of Patents and Trademarks*